US005967945A

United States Patent [19]

Wang

[11] Patent Number: 5,967,945

[45] Date of Patent: Oct. 19, 1999

[54] HEIGHT CONTROL DEVICE FOR TREADMILL RUNNER FRAME

[76] Inventor: Leao Wang, No 1, Lane 154, Charng Long Rd., Taiping City, Taichung, Taiwan

[21] Appl. No.: 09/182,238

[22] Filed: Oct. 30, 1998

[51] Int. Cl.[6] ..... A63B 22/00

[52] U.S. Cl. ..... 482/54; 482/51

[58] Field of Search ..... 482/54, 51

[56] References Cited

U.S. PATENT DOCUMENTS

| | | | |
|---|---|---|---|
| 5,431,612 | 7/1995 | Holden | 482/54 |
| 5,447,479 | 9/1995 | Gvoich | 482/54 |
| 5,460,586 | 10/1995 | Wilkonson et al. | 482/54 |
| 5,599,259 | 2/1997 | Skowronski et al. | 482/54 |

*Primary Examiner*—Glenn E. Richman

[57] ABSTRACT

The preferred embodiment as disclosed in this invention refers to a control device that provides adjustment to the height of a treadmill runner frame. It primarily entails have a through hole, a front lever hole and another anchoring hole for the extended axle furnished along the two connecting pieces according to designated high/low positions respectively in relation to its front and rear configuration. In which, the locations of frame through holes and the front lever through holes are individually connected to the rear of the connecting pieces toward the lower parts. As a result, the said connecting pieces are then connected to the two front sides of the frame through holes and fastened with screws. Then on, the front support lever through holes are fasten to the front lever holes with screw connection. Thereafter, an extended axial bar is inserted through the extended axial through holes between the two connecting pieces, and finished off by installing an adjustment mechanism on top of the said extended axial bar. And the said adjustment mechanism's operating end is so positioned that it extends out from the front side of the runner frame, and fixed in place at the position bump of the front support lever. As a result, when the operating piece of the adjustment mechanism is maneuvered by dragging the threaded lever towards the front of rear, it triggers the extended axial bar to generate a synchronized movement, at this time the connecting pieces will rotate around the front support lever's through holes as the center to produce rotational movement, which will then shift along the position holes along the through holes of the frame to move up and down to achieve modifying the support angles.

4 Claims, 6 Drawing Sheets

HEIGHT CONTROL DEVICE FOR TREADMILL RUNNER FRAME

BACKGROUND OF THE INVENTION

1. Field of the Invention

The preferred embodiment disclosed in this invention pertains to installing a height adjusting mechanism to the runner frame of a treadmill, particularly referring to an innovative invention that provides a simpler construction and can indeed achieve fine-tuning of the support angle of to the runner frame.

2. Description of the Prior Art

Hereunto, a prior art of a patented invention that provides like function as that disclosed in this preferred embodiment can be found in a prior art under the U.S. Pat. No. 5,669,857, and please refer to the illustrations shown in FIGS. 6 and 7, which are the structural and movement illustrations of that particular patent. The illustrations indicate that it primarily relates to having a lever 12 atop the support beams 11 of the front support base 10, and making one end of the lever 12 sufficiently engage with the front rollers 14 located at the runner frame 13. Thereafter, a hydraulic cylinder 15 is installed at an appropriate location close to the lever 12 near one end of the frame 13 between the support beams 11 so that extending or retracting cylinder lever 16 of the hydraulic 15 will alter the angles of the lever 12. While any change to the lever 12 will also change the support angle of the runner frame 13.

Despite that this common-known structure could indeed accomplish the anticipated function, that the complexities of its components are rather high, thus greatly adding to the entire bulk of a treadmill. Therefore, in spite of the fact that the runner frame 13 can be turned upward in a folding position as shown in FIG. 6 in perforated lines, the entire bulk and the space that it takes up remain rather substantial, and does present a just cause for further improvement.

SUMMARY OF THE INVENTION

Based on the above assessment, the inventor, being aware of the conditions described above, has applied considerations aiming to simplify its structure and reduce the bulk, by utilizing years of practical know-how to pursue related research and development aggressively so that the technique of this invention can be brought to practical application. Hence it primarily concerns incorporating the function of the connecting pieces and an extended axial bar to the current support to add a height adjustment device beneath the frame to achieve the anticipated effects and functions as the prime focus of the preferred embodiment disclosed in this invention.

DETAILED DESCRIPTION OF THE INVENTION

Figure 1:
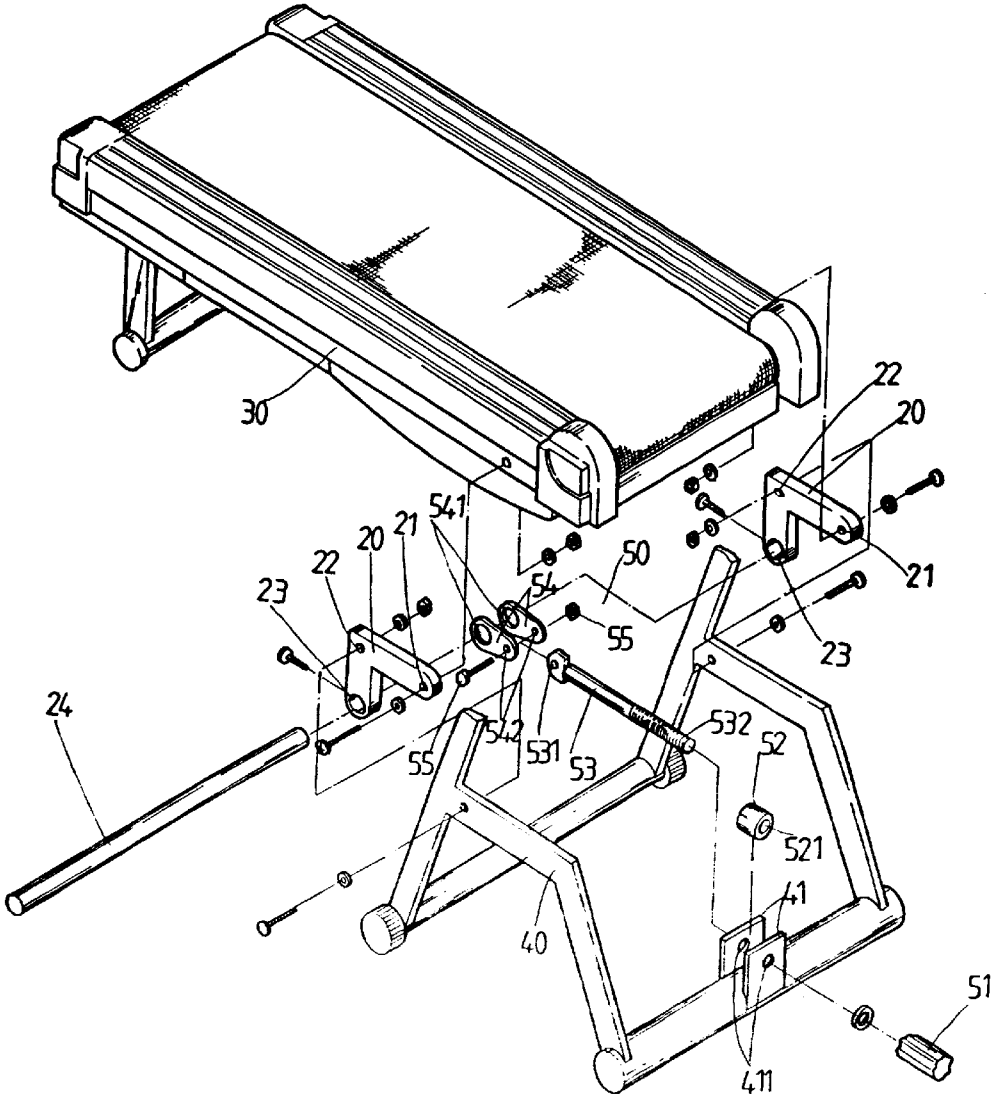
FIG. 1 is a perspective view of a preferred implement of the invention.
Figure 2:
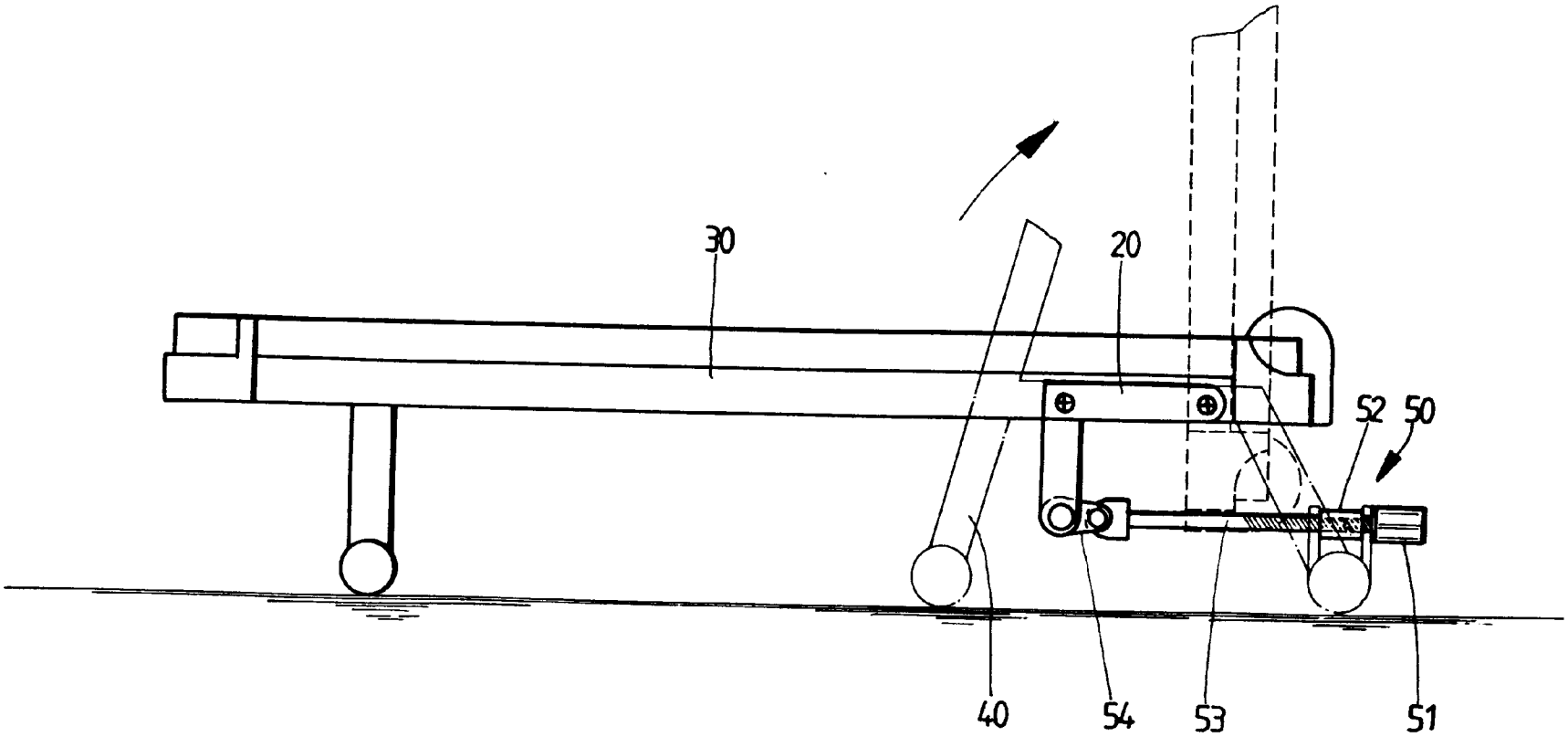
FIG. 2 is a side view of the preferred embodiment proposed by this invention.

Firstly, please refer to drawings 1 and 2 for examples of the preferred embodiment as proposed by this invention. The sketches indicate that it primarily concerns having an anchoring hole 21, a front support lever hole 22 and a hole 23 for the extended axle 24 furnished along the two connecting pieces 20 according to designated positions of varied heights in the front and rear. In which, the frame anchoring holes 21 and the front lever through-holes 22 are separately attached to the front and the center higher positions on the connecting pieces 20, while the location of the hole 23 opening for the extended axle 24 is placed at the lower point of the connecting pieces 20. After that, the connecting pieces 20 are then individually connected to the front support via the hole opening for the extended axle 22. Then, the connecting pieces 20 are separately attached to the two front sides of the runner frame 30 via the hole opening 21. Having completed that, an extended axial bar 24 is then put through the hole openings 23 on the two connecting pieces 20, and finished lastly by installing an adjustment mechanism 50 over the extended axial bar 24 so that the front of the control device of the adjustment mechanism 50 extends out towards the front of the runner frame 30 and positioned at the position brackets 41 located on the front support 40.

The said adjustment mechanism 50 consists of a control device 51, a coupling 52, a threaded pull lever 53 and two conveying pieces 54. In which, the two conveying pieces 54 are placed over the extended axial bar 24 via the larger hole on one end, while the smaller hole on the other end is aligned with the holes of the threaded pull lever 53 and fastened with screws. After that, the threaded part 532 of the threaded pull lever 53 is inserted through the hole openings 411, 521 over the position bump 41 and the coupling 52 and attached to the control device 51 by fastening with a screw.

Figure 3:
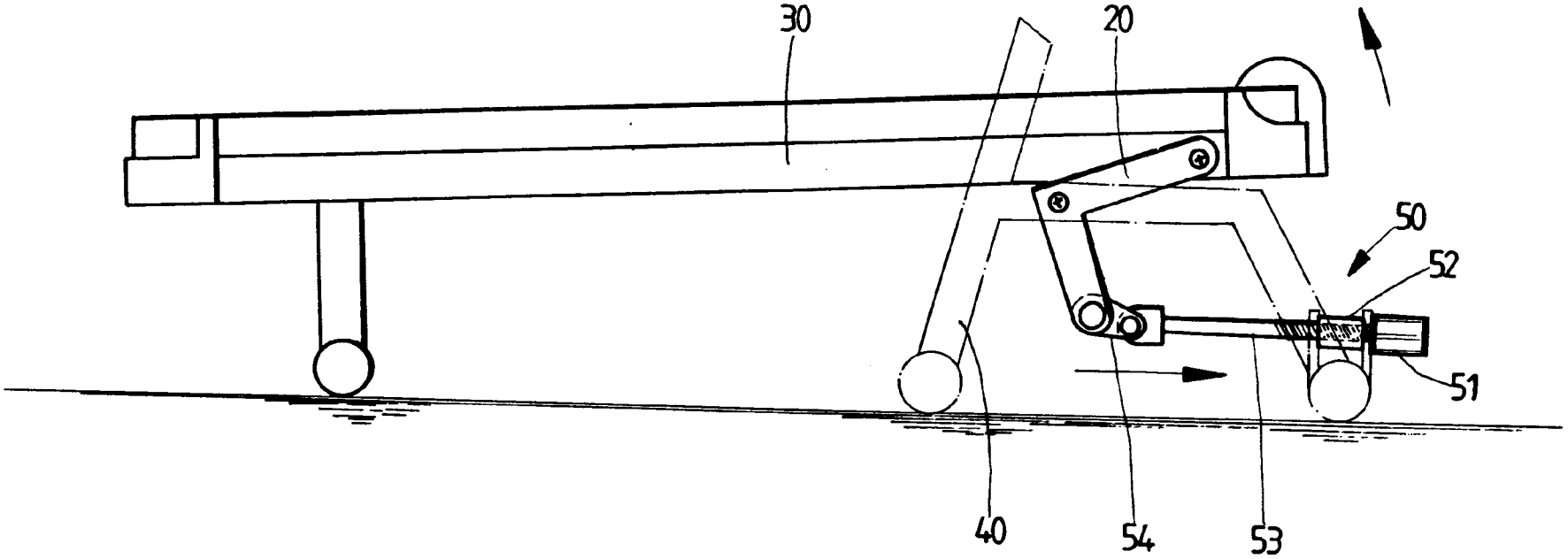
FIG. 3 is a side view showing the movement of the preferred embodiment of this invention.

Therefore, as shown in FIG. 3, when using the control device 51 of the adjustment mechanism to move the threaded lever 53 towards the front or the rear, it also carries the extended axle 24 in a synchronized movement, that further elevates or lowers the through holes 21 of the frame 30 to achieve the anticipated function of changing the support angles.

Moreover, the invention may also rely on the connecting pieces' 20 frame anchoring holes 21 as the axle to flip the runner frame 30 upward into an upright position in a folded condition. (as shown in the dashed lines in FIG. 3)

Figure 5:
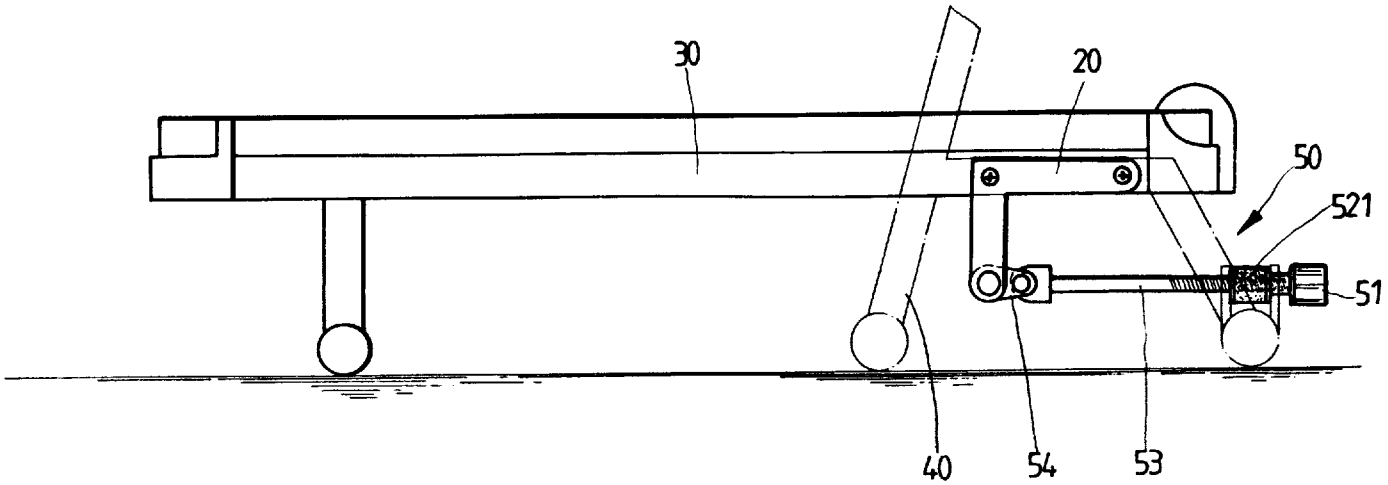
FIG. 5 is a side view of another preferred embodiment of this invention.
Figure 6:
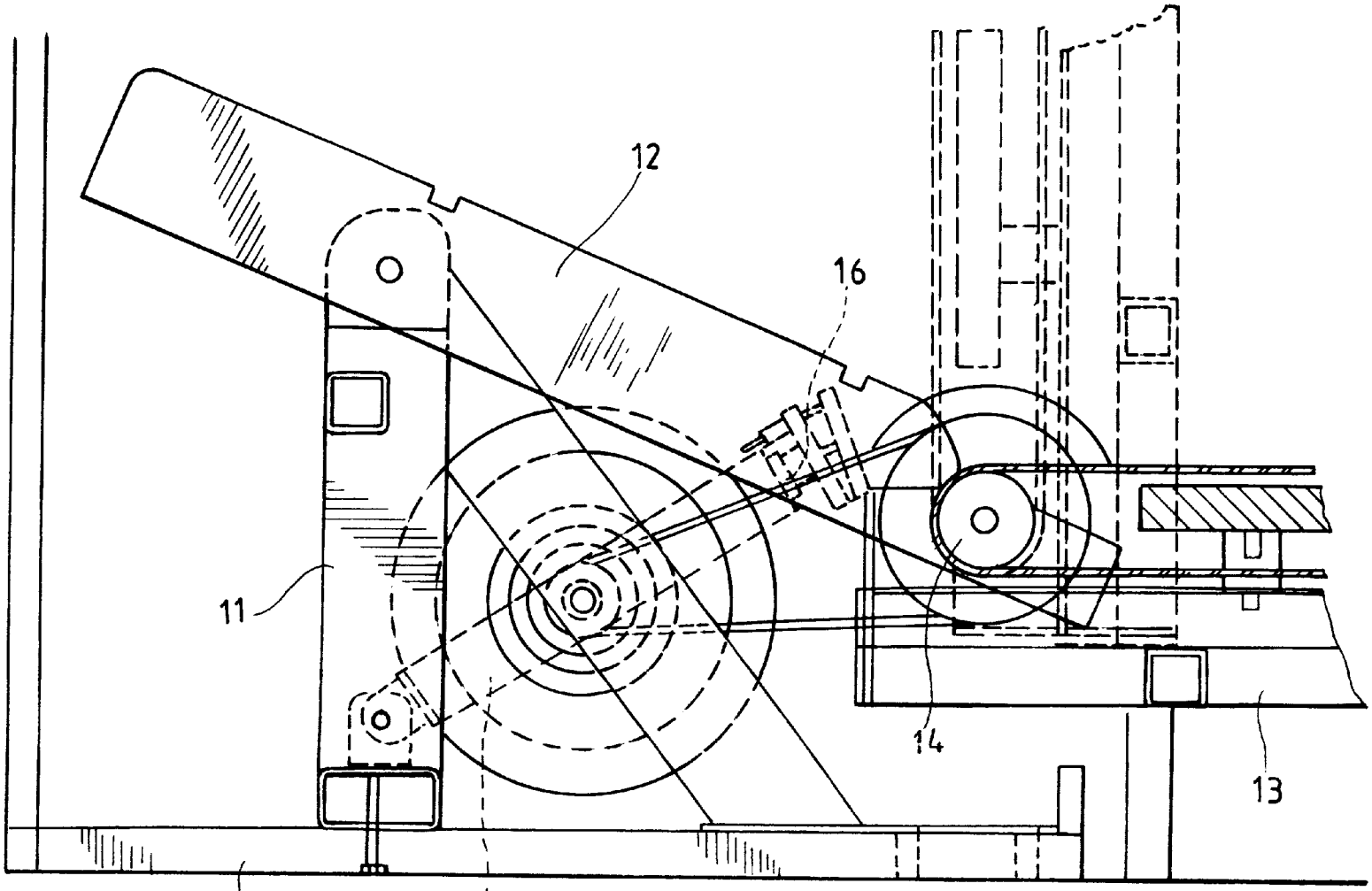
FIG. 6 PRIOR ART
FIG. 6 is a partial side view of a prior art of device.
Figure 7:
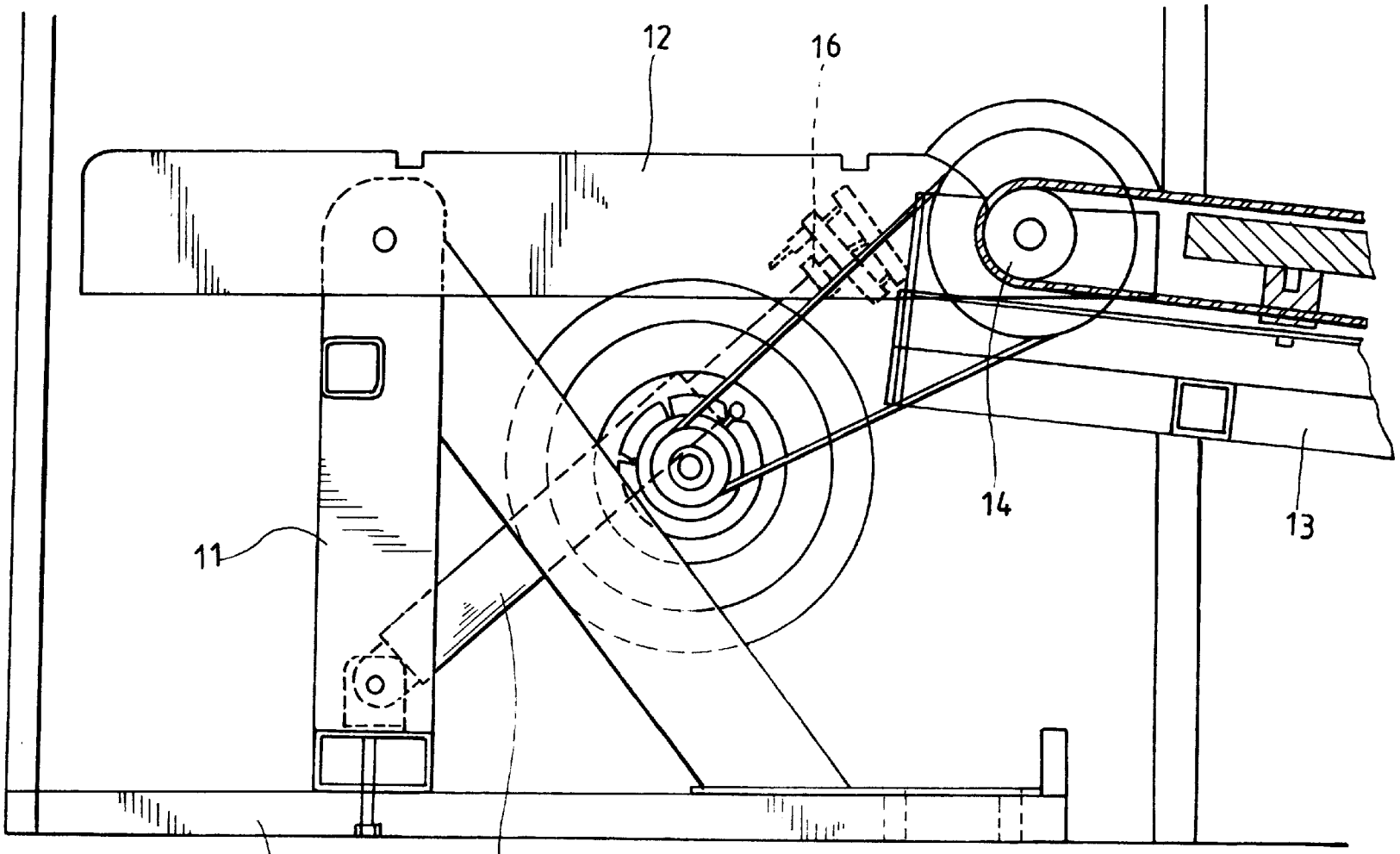
FIG.7 PRIOR ART
FIG. 7 is a partial side view showing the movement of the device of FIG. 6.

In addition, the composition of the coupling piece 52 used in the adjustment mechanism 50 can be of a general grade of rigid or soft rubber molding material, and when the said coupling 52 is made of rubber molding material, it will also act as a buffer coupling 521 that provides adequate absorption of vibrations generating from the runner frame 30. (as shown in FIG. 5)

Figure 4:
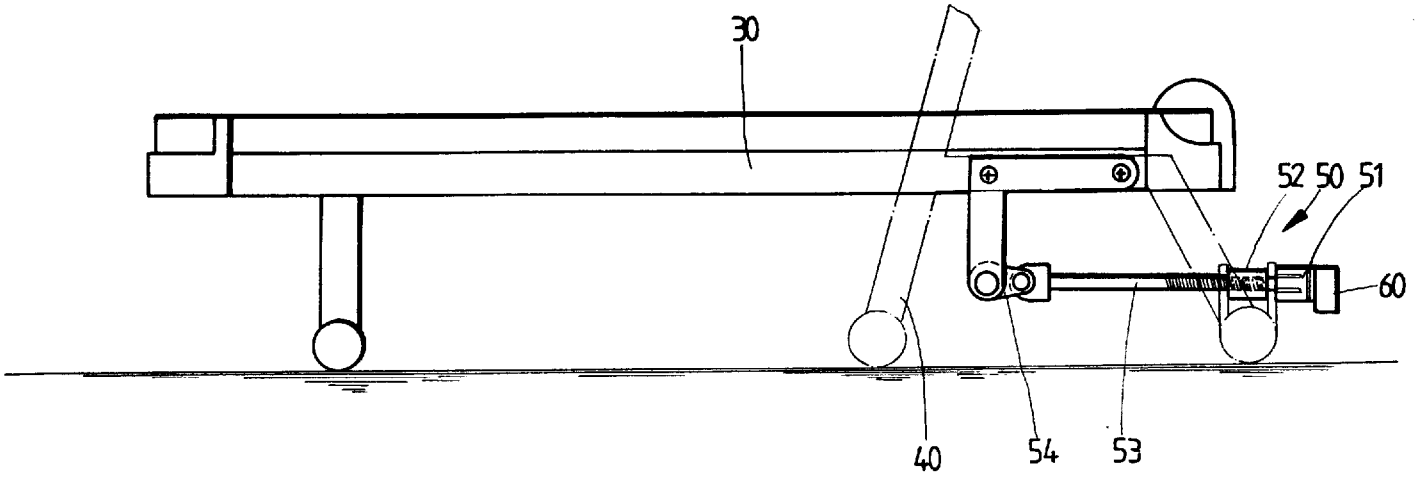
FIG. 4 is a side view of another preferred embodiment of this invention.

Naturally as shown in FIG. 4, to provide more convenient operating feature when maneuvering the adjustment mechanism 50 covered in this invention, an optional electric motor 60 can be incorporated at an appropriate location at the control device 51 making the said motor 60 to carry the control device 51 for clockwise and counter-clockwise rotation. In such way, a user can simply utilize the current control (not shown) to control a desired support angle on the runner frame 30.

Recapping the above, what has been claimed by the current invention has not been found in any similar products sold on the market, or in any related publications or research papers, and it also meets innovative and progressive practical value, that has indeed proven to meet the criteria of applying for a new-model patent listing and deserved to be protected by the Patent Law. Hence, a petition has thus been submitted according to the pertinent law.

I claim:

1. A height control mechanism for a front of a treadmill having a runner frame comprising:

a) a front support;

b) first and second connecting pieces pivotally connected to the front support, each connecting piece having a first portion pivotally connected to a front of the treadmill runner frame, and a second portion;

c) an axle connecting the second portions of the first and second connecting pieces; and, d) a pull lever connected to the axle and having a threaded portion threadingly engaging a control device, such that rotation of the control device causes axial movement of the pull lever which, in turn, causes the first and second connecting pieces to pivot about their connections to the front support to thereby raise and lower the front of the treadmill frame.

2. The height control mechanism of claim 1 further comprising a pair of spaced apart, positioning brackets fixedly mounted on the front support, and a coupling located between the positioning brackets, the pull lever extending through the positioning brackets and the coupling.

3. The height control mechanism of claim 2 wherein the coupling is formed of rubber material.

4. The height control mechanism of claim 2 further comprising an electric motor drivingly connected to the control device.

* * * * *